US008117844B2

(12) United States Patent
Mirolli et al.

(10) Patent No.: US 8,117,844 B2
(45) **Date of Patent: *Feb. 21, 2012**

(54) METHOD AND APPARATUS FOR ACQUIRING HEAT FROM MULTIPLE HEAT SOURCES

(75) Inventors: Mark D. Mirolli, Redwood City, CA (US); Lawrence Rhodes, Livermore, CA (US); Yakov Lerner, Foster City, UT (US); Richard I. Pelletier, Livermore, CA (US)

(73) Assignee: Recurrent Engineering, LLC, Kennett Square, PA (US)

( * ) Notice: Subject to any disclaimer, the term of this patent is extended or adjusted under 35 U.S.C. 154(b) by 446 days.

This patent is subject to a terminal disclaimer.

(21) Appl. No.: 11/779,013

(22) Filed: Jul. 17, 2007

(65) Prior Publication Data

US 2008/0011457 A1 Jan. 17, 2008

Related U.S. Application Data

(62) Division of application No. 10/841,845, filed on May 7, 2004, now Pat. No. 7,305,829.

(51) Int. Cl.
*F01K 25/06* (2006.01)

(52) U.S. Cl. ..... 60/649; 60/653; 60/651; 60/671

(58) Field of Classification Search ..... 60/649, 60/651, 653, 655, 671, 676
See application file for complete search history.

(56) References Cited

U.S. PATENT DOCUMENTS

| | | | |
|---|---|---|---|
| 3,505,810 | A | 4/1970 | Mamiya |
| 3,979,914 | A | 9/1976 | Weber |
| 4,102,133 | A | 7/1978 | Anderson |
| 4,346,561 | A | 8/1982 | Kalina |
| 4,354,821 | A | 10/1982 | Kesselring et al. |
| 4,361,186 | A | 11/1982 | Kalina |
| 4,422,297 | A | 12/1983 | Rojey |
| 4,433,545 | A | 2/1984 | Chang |
| 4,489,563 | A | 12/1984 | Kalina |

(Continued)

FOREIGN PATENT DOCUMENTS

EP 065042 A1 11/1982

(Continued)

OTHER PUBLICATIONS

Written Opinion of the International Searching Authority for PCT/US04/014496, dated Dec. 9, 2004 (3 pages).

(Continued)

*Primary Examiner* — Hoang M Nguyen
(74) *Attorney, Agent, or Firm* — Workman Nydegger

(57) ABSTRACT

The present invention relates to systems and methods for implementing a closed loop thermodynamic cycle utilizing a multi-component working fluid to acquire heat from two or more external heat source streams in an efficient manner utilizing countercurrent exchange. The liquid multi-component working stream is heated by a first external heat source stream at a first heat exchanger and is subsequently divided into a first substream and a second substream. The first substream is heated by the first working stream at a second external heat source stream at a second heat exchanger. The second substream is heated by the second working stream at a third heat exchanger. The first substream and the second substream are then recombined into a single working stream. The recombined working stream is heated by the second external heat source stream at a fourth heat exchanger.

22 Claims, 6 Drawing Sheets

U.S. PATENT DOCUMENTS

| | | | | |
|---|---|---|---|---|
| 4,542,625 | A | 9/1985 | Bronicki | |
| 4,548,043 | A | 10/1985 | Kalina | |
| 4,586,340 | A | 5/1986 | Kalina | |
| 4,604,867 | A | 8/1986 | Kalina | |
| 4,674,285 | A | 6/1987 | Durrant et al. | |
| 4,732,005 | A | 3/1988 | Kalina | |
| 4,763,480 | A | 8/1988 | Kalina | |
| 4,867,674 | A | 9/1989 | Keller et al. | |
| 4,899,545 | A | 2/1990 | Kalina | |
| 4,982,568 | A | 1/1991 | Kalina | |
| 4,996,846 | A | 3/1991 | Bronicki | |
| 5,029,444 | A | 7/1991 | Kalina | |
| 5,038,567 | A | 8/1991 | Mortiz | |
| 5,085,156 | A | 2/1992 | Dykema | |
| 5,095,708 | A | 3/1992 | Kalina | |
| 5,440,882 | A | 8/1995 | Kalina | |
| 5,450,821 | A | 9/1995 | Kalina | |
| 5,572,871 | A | 11/1996 | Kalina | |
| 5,588,298 | A | 12/1996 | Kalina et al. | |
| 5,603,218 | A | 2/1997 | Hooper | |
| 5,649,426 | A | 7/1997 | Kalina et al. | |
| 5,715,682 | A | 2/1998 | Nakata | |
| 5,822,990 | A | 10/1998 | Kalina et al. | |
| 5,913,812 | A | 6/1999 | Smith et al. | |
| 5,950,433 | A | 9/1999 | Kalina | |
| 5,953,918 | A | 9/1999 | Kalina et al. | |
| 6,751,959 | B1 | 6/2004 | McClanahan et al. | |
| 6,769,256 | B1 | 8/2004 | Kalina | |
| 6,829,895 | B2 | 12/2004 | Kalina | |
| 6,910,334 | B2 | 6/2005 | Kalina | |
| 7,305,829 | B2 * | 12/2007 | Mirolli et al. | 60/649 |

FOREIGN PATENT DOCUMENTS

| | | | |
|---|---|---|---|
| EP | 193184 | A1 | 9/1986 |
| EP | 101244 | B1 | 11/1988 |
| EP | 472020 | A1 | 2/1992 |
| EP | 372864 | B1 | 4/1996 |
| EP | 0786590 | | 7/1997 |
| FR | 1546326 | | 11/1968 |
| GB | 2010974 | | 7/1979 |
| JP | 03-199602 | | 8/1991 |
| JP | 07-091211 | | 4/1995 |
| JP | 07-094815 | | 7/1995 |
| JP | 09-203304 | | 8/1997 |
| NZ | 211181 | | 12/1986 |
| NZ | 212813 | | 4/1987 |
| NZ | 231596 | | 8/1992 |
| NZ | 239143 | | 12/1993 |
| NZ | 248146 | | 4/1995 |
| NZ | 247880 | | 8/1995 |
| NZ | 250819 | | 12/1995 |
| NZ | 264705 | | 12/1995 |
| WO | 8605234 | | 9/1986 |
| WO | 2004102082 | A3 | 11/2004 |

OTHER PUBLICATIONS

International Preliminary Report on Patentability for PCT/US04/014496, dated Dec. 9, 2004 (4 pages).
Office Action in U.S. Appl. No. 10/841,845 dated Dec. 9, 2005 (5 pages).
Office Action in U.S. Appl. No. 10/841,845 dated Mar. 15, 2006 (4 pages).
Office Action in U.S. Appl. No. 10/841,845 dated Aug. 24, 2006 (5 pages).
Office Action in U.S. Appl. No. 10/841,845 dated Jan. 22, 2007 (6 pages).
Notice of Allowance in U.S. Appl. No. 10/841,845 dated May 29, 2007 (3 pages).
Supplemental Notice of Allowance in U.S. Appl. No. 10/841,845 dated Oct. 15, 2007 (3 pages).
Issue Notification in U.S. Appl. No. 10/841,845 dated Nov. 21, 2007 (1 page).
European Patent Office, Supplementary European Search Report in Patent Application EP 04760961 dated Aug. 31, 2006 (2 pages).
Australian Patent Office, Examiner's First Report in Patent Application AU 2004239304 dated Aug. 22, 2008 (2 pages).
Chinese Patent Office, Office Action in Patent Application Serial No. 200710162034.0, dated May 8, 2009 (11 pages).
Turkish Patent Office, Examination Report in Patent Application No. 2005/04427 dated Sep. 15, 2008 (6 pages).
Turkish Patent Office, Examination Report in Patent Application No. 2005/04427 dated Jun. 13, 2007 (6 pages).
Indonesian Patent Office, Official Action in Patent Application No. W-002005-02982 dated Jun. 2010 (2 pages).
Indonesian Patent Office, Official Action in Patent Application No. W-002005-02982 dated Jun. 6, 20007 (2 pages).
New Zealand Patent Office, Examination Report in Patent Application No. 543497 dated Sep. 16, 2006 (2 pages).
Japanese Patent Office, Office Action in Patent Application Serial No. 2006-532899 dated Sep. 9, 2009 (28 pages).

* cited by examiner

METHOD AND APPARATUS FOR ACQUIRING HEAT FROM MULTIPLE HEAT SOURCES

CROSS-REFERENCE TO RELATED APPLICATIONS

This application is a divisional application of prior application Ser. No. 10/841,845, filed on May 7, 2004 now U.S. Pat. No. 7,305,829, the contents of which is hereby incorporated by reference in its entirety.

BACKGROUND OF THE INVENTION

1. The Field of the Invention

The invention relates to implementing a thermodynamic cycle utilizing countercurrent heat exchange. In more particular, the invention relates to methods and apparatuses for utilizing a multi-component working fluid to acquire heat from multiple external heat source streams.

2. The Relevant Technology

Thermal energy can be usefully converted into mechanical and then electrical form. Methods of converting the thermal energy of low and high temperature heat sources into electric power present an important area of energy generation. There is a need for increasing the efficiency of the conversion of such low temperature heat to electric power.

Thermal energy from a heat source can be transformed into mechanical and then electrical form using a working fluid that is expanded and regenerated in a closed system operating on a thermodynamic cycle. The working fluid can include components of different boiling temperatures, and the composition of the working fluid can be modified at different places within the system to improve the efficiency of energy conversion operation.

Typically multi-component working fluids include a low boiling point component and higher boiling point component. By utilizing the combination of the low boiling point component and a higher boiling point component, an external heat source stream such as industrial waste heat can be more efficiently utilized for electricity production. In applications where there are two or more heat sources available for electricity production, multi-component working fluids can be further utilized to improve the efficacy of heat acquisition and electricity generation. The two or more heat sources can be utilized to heat the low boiling point component to convert the low boiling point component from a liquid state to a vapor state. By heating the low boiling point component to the vapor state, heat energy from the external heat source stream is converted to kinetic energy which can more easily be converted to useful energy such as electricity.

BRIEF SUMMARY OF THE INVENTION

The present invention relates to systems and methods for implementing a closed loop thermodynamic cycle utilizing a multi-component working fluid to acquire heat from two or more external heat source streams in an efficient manner utilizing countercurrent exchange. Typically multi-component working fluids include a low boiling point component and higher boiling point component. Where the multi-component working fluid is heated, utilizing two or more external heat source streams, the heat acquisition process can be further optimized to improve electricity generation. In one embodiment, the heat acquisition process is utilized to convert both the low boiling point component and the higher boiling point component to a vapor state.

Where the temperature of the external heat source stream is sufficient to convert both the low boiling point component and the higher boiling point component to a vapor state, the heat energy from the external heat source streams can be optimally converted in both a high energy state and the low energy state. For example, when the external heat source stream is at a lower temperature, the low boiling point component can be converted to the vapor state. Where the external heat source stream is at a higher temperature, the higher boiling point component can be converted to the vapor state. Where the temperature of an external source of energy exceeds the temperature needed to convert the higher boiling point component to the vapor state, the external heat source stream can be utilized to super heat the vapor working stream.

According to one embodiment of the present invention, a liquid multi-component working stream is heated by a first external heat source stream at a first heat exchanger and subsequently heated by second external heat source stream at a second heat exchanger in series with the first heat exchanger. In another embodiment, the liquid multi-component working stream is heated by a first external heat source stream at a first heat exchanger and is subsequently divided into a first substream and a second substream. The first substream is heated by the first external heat source stream at a second heat exchanger. The second substream is heated by the second external heat source stream at a third heat exchanger. The first substream and the second substream are then recombined into a recombined working stream. The recombined working stream is heated by the second external heat source stream at a fourth heat exchanger to form a heated gaseous working stream. According to one embodiment of the present invention, subsequent to being heated by the fourth heat exchanger, the heated gaseous working stream is expanded to transform the energy of the heated gaseous working stream to a usable form. Expanding the heated gaseous working stream transforms it into a spent stream which is sent to a distillation/condensation subsystem to convert the spent stream into a condensed stream.

According to one embodiment of the present invention, the first external heat source stream is of a different temperature than the second external heat source stream. In one embodiment, the first external heat source stream and the second external heat source stream have overlapping same temperature regions. In one embodiment, subsequent to being pumped to a higher pressurization, the liquid working stream comprises a sub-cooled liquid. In the embodiment, the working fluid is heated to a point at or near the bubble point in the first heat exchanger. Subsequent to being divided, the first substream and the second substream are heated to near the dew point. After the first substream and the second substream are recombined, the recombined working fluid is superheated to a heated gaseous working stream.

In another embodiment, more than two heat sources are utilized to heat the working fluid. For example, in one embodiment three external heat source streams are utilized to heat the working fluid. In one embodiment, two or more Heat Recovery Vapor Generators (HRVG) having separate expansion turbines, or an expansion turbine having first and second stages, are utilized to convert energy from the heated gaseous working stream. In another embodiment, one of the external heat source streams is a low temperature source and the other external heat source stream is a higher temperature source. In one embodiment, the low temperature source and the high temperature source have overlapping same temperature regions. In another embodiment, the low temperature source and the higher temperature source do not have overlapping same temperature regions.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
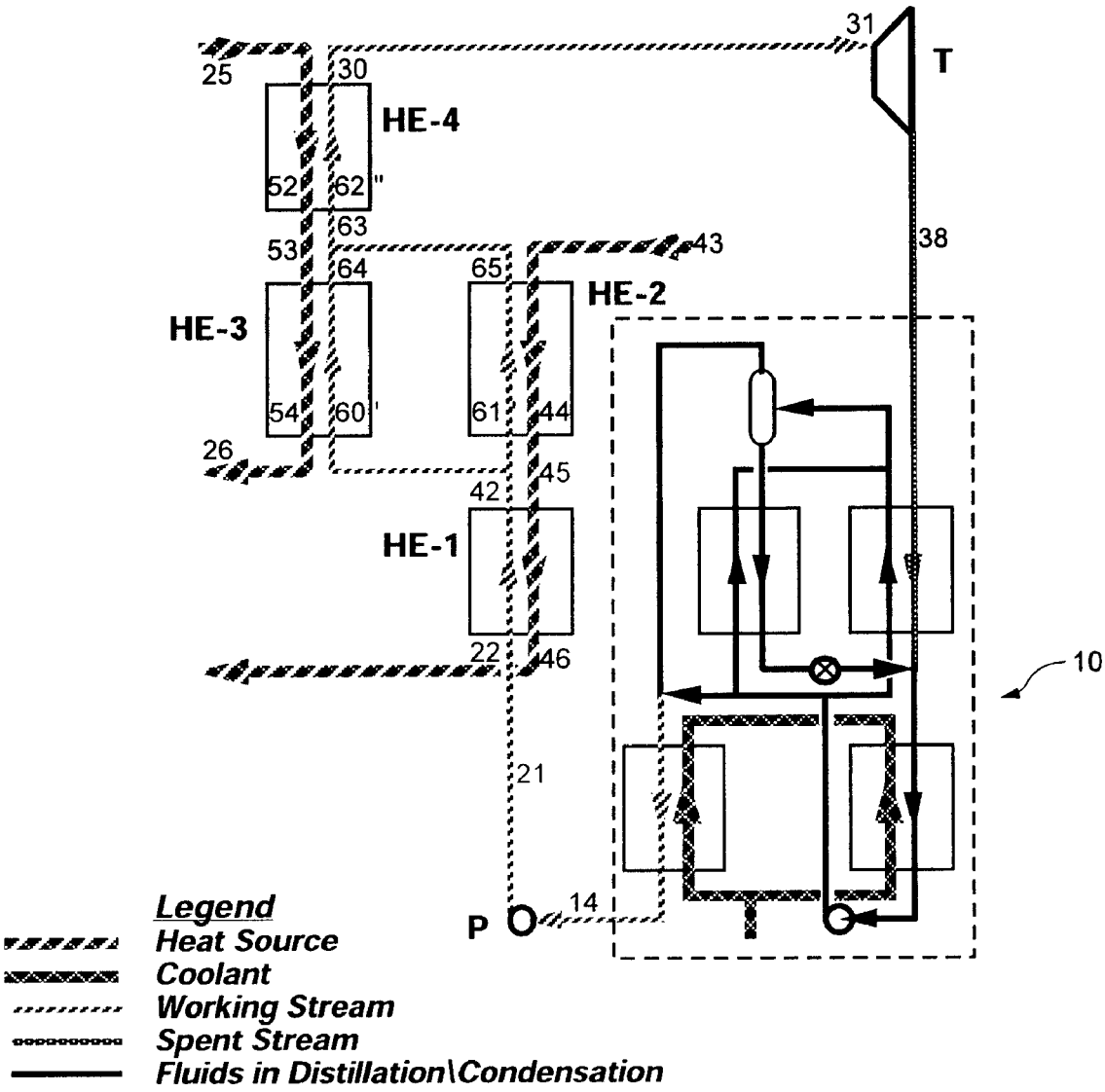
FIG. 1 illustrates a thermodynamic system for acquiring heat from a first external heat source stream and a second external heat source stream according to one embodiment of the present invention.

The present invention relates to systems and methods for implementing a closed loop thermodynamic cycle utilizing a multi-component working fluid to acquire heat from two or more external heat source streams in an efficient manner utilizing countercurrent exchange. Typically multi-component working fluids include a low boiling point component and higher boiling point component. Where the multi-component working fluid is heated utilizing two or more external heat source streams, the heat transfer can be optimized to convert both the low boiling point component and the higher boiling point component to a vapor state for more efficient energy conversion.

Where the temperature of the external heat source stream is sufficient to convert both the low boiling point component and the higher boiling point component to a vapor state, the heat energy from the external heat source streams can be optimally converted in both a high energy state and a low energy state. For example, when the external heat source stream is at a lower temperature the low boiling point component can be converted to the vapor state. Where the external heat source stream is at a higher temperature, the higher boiling point component can be converted to the vapor state. Where the temperature of an external source of energy exceeds the temperature needed to convert the higher boiling point component to the vapor state, the external heat source stream can be utilized to super heat the vapor working stream.

According to one embodiment of the present invention, a liquid multi-component working stream is heated by a first external heat source stream at a first heat exchanger and subsequently heated by a second external heat source stream at a second heat exchanger in series with the first heat exchanger. In another embodiment, the liquid multi-component working stream is heated by a first external heat source stream at a first heat exchanger and is subsequently divided into a first substream and a second substream. The first substream is heated by the first external heat source stream at a second heat exchanger. The second substream is heated by the second external heat source stream at a third heat exchanger. The first substream and the second substream are then recombined into a recombined working stream. The recombined working stream is heated by the second external heat source stream at a fourth heat exchanger to form a heated gaseous working stream. According to one embodiment of the present invention, subsequent to being heated by the fourth heat exchanger the heated gaseous working stream expanding transforms it into a spent stream which is sent to a distillation/condensation subsystem to convert the spent stream into a condensed stream.

According to one embodiment of the present invention, subsequent to being combined with a second partial working stream a partial heated gaseous working stream is expanded to transform the energy of the partial heated gaseous working stream to a usable form. Expanding the heated gaseous working stream transforms it into a spent stream which is sent to a distillation/condensation subsystem to convert the spent stream into a condensed stream.

According to one embodiment of the present invention, the first external heat source stream is of a different temperature than the second external heat source stream. In one embodiment, the first external heat source stream and the second external heat source stream have overlapping same temperature regions. In one embodiment, subsequent to being pumped to a higher pressurization, the liquid working stream comprises a sub-cooled liquid. In the embodiment, the working fluid is heated to a point at or near the bubble point in the first heat exchanger. Subsequent to being divided, the first substream and the second substream are heated to near the dew point. After the first substream and the second substream are recombined, the recombined working fluid is superheated to a heated gaseous working stream.

In another embodiment, more than two heat sources are utilized to heat the working fluid. For example, in one embodiment three external heat source streams are utilized to heat the working fluid. In one embodiment, two or more Heat Recovery Vapor Generators (HRVG) having separate expansion turbines, or an expansion turbine having first and second stages, are utilized to convert energy from the heated gaseous working stream. In another embodiment, one of the external heat source streams is a low temperature source and the other external heat source stream is a higher temperature source. In one embodiment, the low temperature source and the high temperature source have overlapping same temperature regions. In another embodiment, the low temperature source and the higher temperature source do not have overlapping same temperature regions.

FIG. 1 illustrates a thermodynamic system for acquiring heat from a first external heat source stream and a second external heat source stream according to one embodiment of the present invention. In the illustrated embodiment, a spent stream 38 is condensed in distillation/condensation subsystem 10 forming a condensed stream 14. Condensed stream 14 is pressurized by pump P to form a liquid working stream 21. Liquid working stream 21 comprises a low boiling point component and a higher boiling point component and is configured to be heated with two or more external heat source streams to produce a heated gaseous working stream. In one embodiment of the present invention, the liquid working stream 21 is still in a sub-cooled state.

A number of different types and configurations of multi-component working streams can be utilized without departing from the scope and spirit of the present invention. For example, in one embodiment the working stream comprises an ammonia-water mixture. In another embodiment, the working stream is selected from the group comprising two or more hydrocarbons, two or more freons, mixtures of hydrocarbons and freons, or other multi-component working streams having a low boiling point component and a higher boiling point component. In yet another embodiment, the multi-component working stream is a mixture of any number of compounds with favorable thermodynamic characteristics and solubility. As will be appreciated by those skilled in the art, a variety of different types and configurations of distillation/condensation subsystems are known in the art and can be utilized without departing from the scope and spirit of the present invention.

The first external heat source stream 43-46 heats the liquid working stream 22-42 in a heat exchanger HE-1 in the path 45-46. Heating of liquid working stream 22-42 increases the temperature of liquid working stream 22-42 commensurate with the temperature of first external heat source stream in path 45-46. In one embodiment of the present invention, the temperature of the working stream at point 42 approximates the bubble point of the low boiling point component. Where the temperature of the working stream at point 42 is less than the bubble point, the working stream comprises a liquid working stream in which both the low boiling point component and the high bubble point component are in a liquid state.

As will be appreciated by those skilled in the art, a variety of different types and configurations of external heat source streams can be utilized without departing from the scope and spirit of the present invention. For example, in one embodiment at least one of the external heat source streams comprises a liquid stream. In another embodiment, at least one of the external heat source streams comprises a gaseous stream. In yet another embodiment, at least one of the external heat source streams comprises a combined liquid and gaseous stream. In one embodiment, the external heat source stream in path 45-46 comprises low temperature waste heat water. In another embodiment, heat exchanger HE-1 comprises an economizer preheater.

The working stream at point 42 is divided into first substream 61 and second substream 60. In one embodiment of the present invention, the working fluid is split between substream 61 and substream 60 in a ratio approximately proportional to the heat that flows from each source. In another embodiment, first substream 61 and second substream 60 are at the bubble point and have substantially similar parameters except for flow rates. The first external heat source stream flows from point 43 to point 44 to heat the first substream 61-65 in the heat exchanger HE-2. The temperature of first external heat source stream in path 43-44 is greater than the temperature of first external heat source stream in path 45-46 due to heat exchange that occurs in heat exchanger HE-2. The higher temperature of first external heat source stream in path 43-44 heats the first substream 61-65 to a higher temperature than the working fluid 22-42, which is heated by first external heat source stream in path 45-46. In one embodiment, the first substream is heated past the boiling point region of the low boiling point component but below the boiling point region of the higher boiling point component. In the embodiment, the first substream has undergone partial vaporization and includes a vapor portion and a liquid portion.

The second external heat source stream 25-26 flows from point 53 to point 54 to heat the second substream 60-64 in the heat exchanger HE-3. In the illustrated embodiment, the second external heat source stream in path 53-54 shares a same temperature region with the first external heat source stream in path 43-44. As a result, the temperature of the second heat source in path 53-54 and first external heat source stream in path 43-44 is approximately the same. Similarly, the heat exchange that occurs in heat exchangers HE-2 and HE-3 is similar due to the similar temperatures of second external heat source stream in path 53-54 and first external heat source stream in path 43-44. As a result, second substream 60-64 approximates the temperature of first substream 61-65. Second substream 60-64 is heated to a higher temperature than the working fluid 22-42. In one embodiment, the second substream is heated past the boiling point region of the low boiling point component but below the boiling point region of the higher boiling point component. In the embodiment, the second substream has undergone partial vaporization and includes a vapor portion and a liquid portion.

First substream 65 and second substream 64 are recombined into a recombined working fluid 63. Where the first substream 65 and the second substream 64 are heated past the boiling point of the low boiling point component but below the boiling point of the higher boiling point component, the recombined working fluid is partially vaporized and includes a vapor portion and a liquid portion. The second external heat source stream flows in path 25-52 to heat recombined working fluid 62-30 in heat exchanger HE-4.

The temperature of second external heat source stream in path 25-52 is greater than the temperature of second external heat source stream in path 53-54 due to heat exchange that occurs in heat exchanger HE-4. The higher temperature of second external heat source stream in path 25-52 heats the recombined working stream 62-30 to a higher temperature than the recombined working stream 63. In one embodiment, the recombined working stream 62-30 is heated past the boiling point region of both the low boiling point component and the boiling point of the higher boiling point component to form a heated gaseous working stream 31. In the embodiment, the heated gaseous working stream 31 has undergone total vaporization and includes only a vapor portion. In another embodiment, the heated gaseous working stream 31 has not undergone total vaporization and includes a vapor portion and a liquid portion.

By utilizing first and second substreams for overlapping same temperature regions of the first and second external heat source streams, the increased heat requirement of the working fluid boiling region can be transferred in an efficient a manner that increases the power production capacity of the thermodynamic system so that more power can be generated than would be the case if the two heat sources were used in separate generating systems. In one embodiment of the present invention heat exchanger HE-1, heat exchanger HE-2, heat exchanger HE-3, and heat exchanger HE-4 comprise a Heat Recovery Vapor Generator (HRVG). The function of the HRVG is to heat working fluid at a high pressure from subcooled liquid to a superheated vapor to acquire heat from waste heat sources (typically hot gases or liquids). The superheated vapors are admitted into a power generating turbine to convert the vapor into useful energy.

For the type of working fluid under discussion, the ranges of sensible heat acquisition include sub-cooled liquid up to the bubble point and the dew point up through superheated vapor. The working fluids have a heat capacity which varies relatively little with temperature. In other words, in each region the working fluid gains about the same amount of temperature for an equal amount of heat input, though the temperature gain is somewhat larger in the vapor than in the liquid. Between the bubble point and the dew point lies the boiling region, which for a multiple-component working fluid spans a range of temperatures. In this region, much more heat is utilized for each unit of working fluid temperature gain, and the amount can be variable. As will be appreciated by those skilled in the art, the type of working fluid utilized, the degree to which it is heated, and the amount of vaporization can vary without departing from the scope and spirit of the present invention. For example, in one embodiment, the parameters of the working fluid are dependent on the type and temperature of external heat source stream utilized. In another embodiment, the parameters of the working fluid are dependent on the configuration and juxtaposition of components of the HRVG.

In one embodiment the working fluid is a high-pressure sub-cooled liquid at point 21. The stream continues to point 22, which may be at a slightly lower pressure due to piping and control valve losses. In the embodiment, the first external heat source stream 43-46 comprises a low temperature source and the second external heat source stream comprises a higher temperature external heat source stream. At point 22 the liquid working stream enters heat exchanger HE-1 where it is heated by the low temperature part of the low temperature source 45-46, emerging at point 42 still slightly sub-cooled. (It is also possible that mechanical considerations would allow working fluid 42 to be somewhat above the bubble point as long as its vapor fraction is small enough so that the working fluid still flows smoothly through the 60/61 split. In another embodiment it can be desirable to begin to boil only in the presence of both heat source streams.)

In the illustrated embodiment the working fluid 42 splits into substreams 60 and 61 in a ratio approximately proportional to the heat flows from the first and second external heat source stream. Substreams 60 and 61 are at the bubble points, and have parameters that are substantially the same except for flow rates. The substreams 61-65 and 60-64 continue through heat exchangers HE-2 and HE-3, absorbing heat from the higher-temperature and lower-temperature external heat source streams respectively, attaining warmer and preferably similar parameters at points 64 and 65 to where the streams are recombined at point 63. Point 63 may be above or below the dew point. The superheating of the recombined working fluid is finished in HE-4 by heating from the higher-temperature heat source stream, attaining the parameters of point 30.

Once the heated gaseous working stream 30 has left the heat exchanger HE-4 it moves to turbine T. The turbine T expands the heated gaseous working stream to transform the energy of the heated gaseous working stream into a useable form. When the heated gaseous working stream is expanded it moves to a lesser pressure providing useful mechanical energy to turbine T to generate electricity or other useful energy and produces a spent stream. As the cycle is closed, the spent stream moves to the distillation/condensation subsystem where the expanded spent stream is condensed into a condensed stream in preparation for being pumped to a higher pressurization by pump P.

Figure 2:
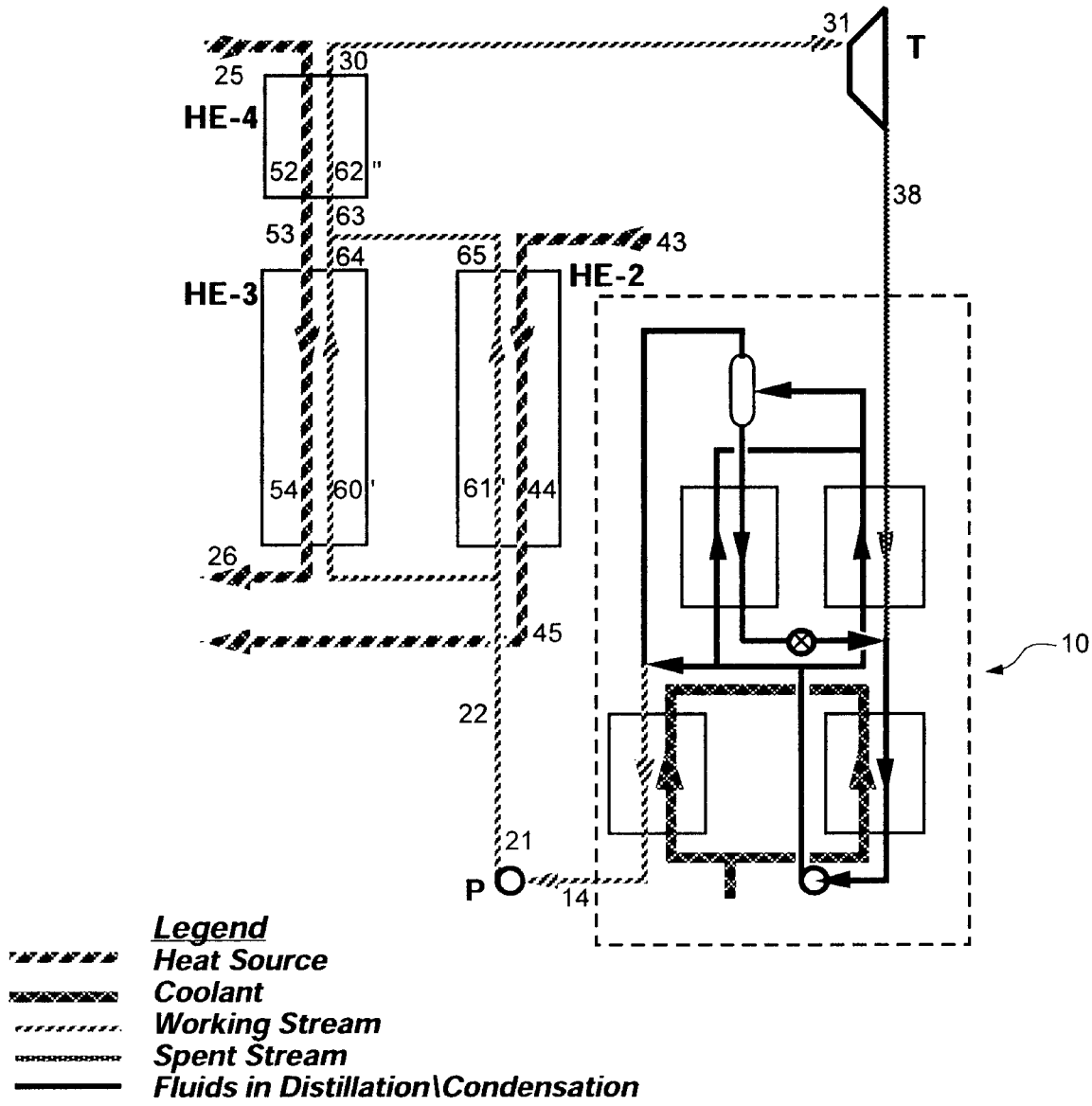
FIG. 2 illustrates a thermodynamic system for acquiring heat from a first external heat source stream and a second external heat source stream having overlapping temperature regions according to one embodiment of the present invention.

FIG. 2 illustrates a thermodynamic system for acquiring heat from a first external heat source stream 43-45 and a second external heat source stream 25-26 having overlapping temperature regions according to one embodiment of the present invention. In the illustrated embodiment, the liquid working stream 22 is divided to form a first substream 61 and a second substream 60 rather than being heated at a heat exchanger HE-1 (see FIG. 1). As a result, liquid working stream 22 is heated from a sub-cooled liquid past the boiling point utilizing heat exchanger HE-2 and heat exchanger HE-3. First substream 61-65 is heated in heat exchanger HE-2. Second substream 60-64 is heated in heat exchanger HE-3. First substream 61-65 and second substream 60-64 are recombined at point 63 in a recombined stream. The recombined stream is superheated at heat exchanger HE-4.

As will be appreciated by those skilled in the art, different configurations of closed loop thermodynamic systems can be utilized without departing from the scope and spirit of the present invention. The use of additional heat exchangers can optimize heat transfer within the system to maximize the amount of heat exchange that can be acquired from external heat source streams. However, additional components can add additional cost and complexity in the system while providing unnecessary optimization.

Where the temperature of the external heat source streams is sufficient to produce desired temperatures of the working fluid, such optimization may not be required. Alternatively, where the desired temperatures of the working fluid are sufficiently low that optimization is not required, a system may not require additional heat exchangers. For example, in some prospective heat sources the temperature of the higher temperatures source (second external heat source stream 25-26) must be a good deal higher than ambient because of flue gas acid dew point corrosion requirements. In such systems, optimization provided by the use of heat exchanger HE-1 may be necessary. Where there is no such constraint, as in the illustrated embodiment, additional cost associated with the inclusion of heat exchanger HE-1 may not be required.

Figure 3:
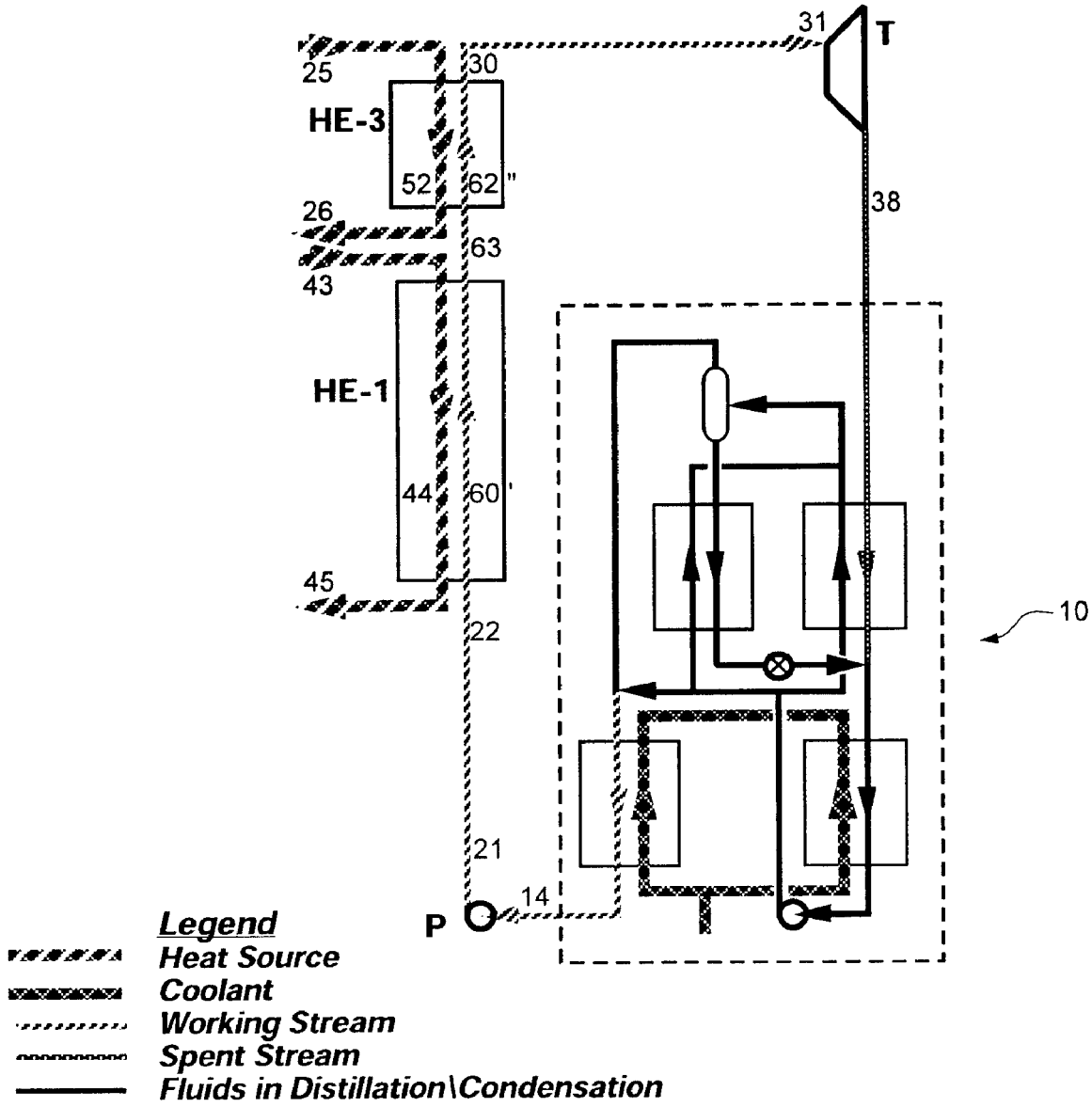
FIG. 3 illustrates a thermodynamic system for acquiring heat from a first external heat source stream and a second external heat source stream positioned in series according to one embodiment of the present invention.

FIG. 3 illustrates a thermodynamic system for acquiring heat from a first heat source and a second heat source having non-overlapping temperature regions according to one embodiment of the present invention. In the illustrated embodiment, the liquid working stream moves from point 22 to heat exchanger HE-1. Liquid working stream 60-63 is heated by first external heat source stream 43-45 at heat exchanger HE-1. From point 63 working stream moves to heat exchanger HE-3. Working stream 62-30 is heated by second external heat source stream 25-26 at heat exchanger HE-3.

In the illustrated embodiment, the multi-component working stream is heated without dividing the multi-component working stream into a first and second substream. The first external heat source stream 43-45 and the second external heat source stream 25-26 do not share overlapping same temperature regions. The first external heat source stream 43-45 comprises a low temperature source and the second external heat source stream 25-26 comprises a higher temperature source. The illustrated system can be utilized where the temperature of point 26 must be of a value not far above the temperature of point 43. Where the optimization required by heat exchanger HE-2 is not required or where the use of heat exchanger HE-2 would not be economical, two heat exchangers in series as illustrated in FIG. 3 can be utilized. The use of two heat exchangers in series can be desirable where the first and second heat source flows are comparable.

As will be appreciated by those skilled in the art, a variety of types and configurations of multiple heat exchangers in series can be utilized without departing from the scope and spirit of the present invention. For example, in one embodiment, a third heat exchanger in series can be utilized. In another embodiment, more than three heat exchangers can be utilized without departing from the scope and spirit of the present invention.

As will be appreciated by those skilled in the art, a variety of types and configurations of heat exchangers can be utilized with the thermodynamic systems of the present invention without departing from the scope and spirit of the present invention. For example, in one embodiment one or more of the multiple heat exchangers comprises a boiler. In another embodiment, one or more of the multiple heat exchangers comprise an evaporator. In another embodiment, one or more of the multiple heat exchangers comprise an economizer preheater. In another embodiment, another type of heat exchanger that allows the transfer of heat from an external heat source stream to a working fluid stream is utilized. In yet another embodiment, the type of heat exchanger utilized is determined by its placement and/or function in the system. The heat exchanger is one example of a means for transferring heat to a working stream.

Figure 4:
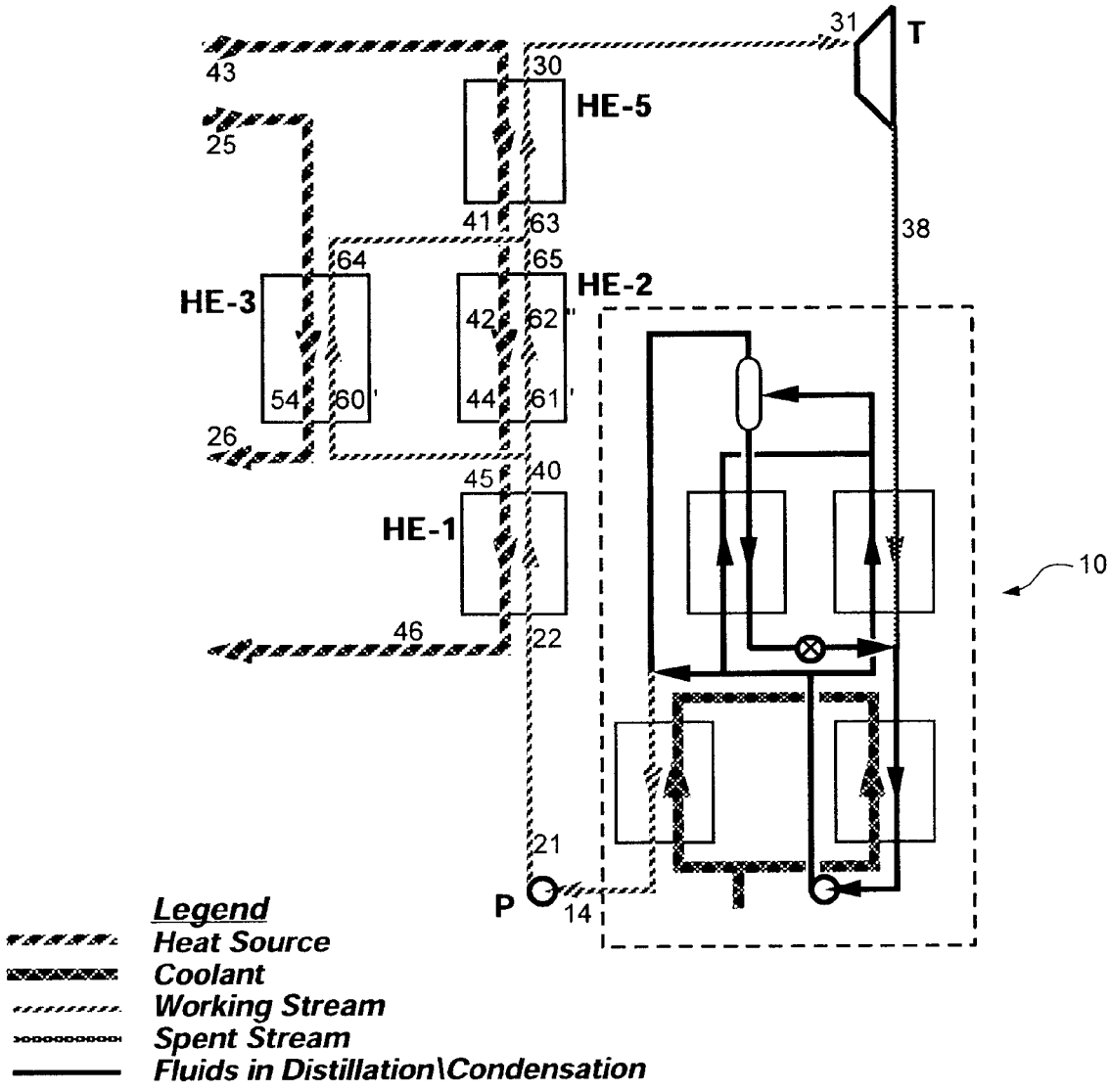
FIG. 4 illustrates a thermodynamic system for acquiring heat from a first external heat source stream and a second external heat source stream having overlapping same temperature regions in which the first external heat source stream comprises a higher temperature source.

FIG. 4 illustrates a thermodynamic system for acquiring heat from a first external heat source stream and a second external heat source stream having overlapping temperature regions in which the first external heat source stream is the higher temperature source. In the embodiment, working stream 22-40 is heated by first external heat source stream 43-46 in path 45-46 in heat exchanger HE-1. The working stream 40 is divided into first substream 61 and second substream 60. First substream 61-65 is heated in heat exchanger HE-2 by first external heat source stream 43-46 in path 42-44. Second substream 60-64 is heated in heat exchanger HE-3 by second external heat source stream 25-26.

Subsequent to heating in heat exchanger HE-2 and heat exchanger HE-3, the first and second substreams are recombined into a recombined stream 63. The recombined stream 63-30 is heated in heat exchanger HE-5 to transfer heat from first external heat source stream 43-46 in path 63-30. Where the temperature of first external heat source stream 43-46 at point 43 is higher than the temperature of second heat source 25-26 at point 25, the superheating of working stream 63-30 is accomplished by the first external heat source stream 43-46 at heat exchanger HE-5 in path 43-41. In the embodiment, second heat source stream 25-26 is used primarily to add heat in the boiling region.

In the embodiment, heat from the first and second external heat source streams is optimized utilizing the overlapping same temperature regions of the external heat source streams even where the first external heat source stream is the high temperature source. The first external heat source stream is utilized both to preheat the liquid working stream and to superheat the recombined working stream in addition to providing heat in the boiling region. As will be appreciated by those skilled in the art, a variety of types and configurations methods and apparatuses for utilizing two working streams to heat a multi-component working stream in a single HRVG can be utilized without departing from the scope and spirit of the present invention.

Figure 5:
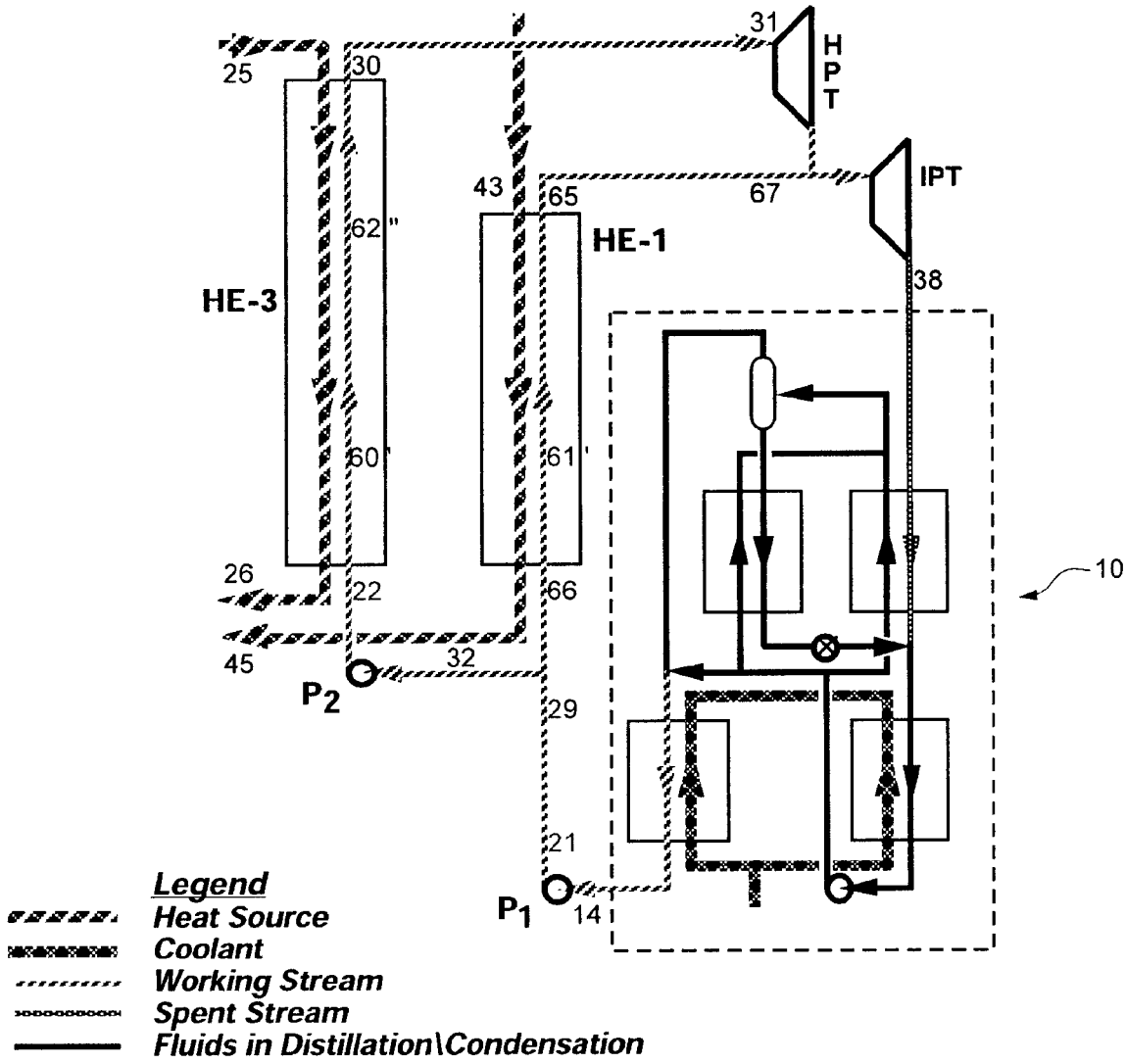
FIG. 5 illustrates a thermodynamic system for acquiring heat from a first external heat source stream using a first heat recovery vapor generator at a high working fluid pressure and a second external heat source stream utilizing a second heat recovery vapor generator at a low working fluid pressure according to one embodiment of the present invention.

FIG. 5 illustrates a thermodynamic system for acquiring heat from a first heat source using a first heat recovery generator and a second heat source utilizing a second heat recovery vapor generator according to one embodiment of the present invention. In the illustrated embodiment, the condensed stream 14 is pumped to a higher pressurization at pump P1 to form a liquid working stream 21. The liquid working stream is split at point 29 into a first substream 66 and a second substream 32. First substream 66-65 is heated by the first external heat source stream 43-45 in the heat exchanger HE-1. Once the first substream is heated in the heat exchanger HE-1 it is converted into a heated gaseous working stream 65 which is sent an intermediate pressure turbine IPT without being recombined with the second substream. Second substream 32 is pumped to yet a higher pressurization at pump P2. After being pumped to a higher pressurization, working fluid 22-30 is heated by a second heat source 25-26 in heat exchanger HE-3 and becomes a heated gaseous working stream 30. Heated gaseous working stream 30 is sent to a high pressure turbine turbine HPT to be expanded at a high pressure and recombined with stream 67 to form stream 44. In the illustrated embodiment, the first external heat source stream 43-45 comprises a low temperature source and the second external heat source stream 25-26 comprises a higher temperature source. Additionally, each of the substreams is heated in a separate HRVG rather than recombining the streams within a single HRVG system.

In the embodiment, the working fluid parameters at point 65 contain too much non-vaporized liquid to transport practically at the pressure necessary for the turbine HPT inlet. Accordingly, the working fluid 66-67 and associated heat exchanger HE-1 are pressurized to a lower pressurization while the working fluid 22-30 and associated heat exchanger HE-3 are pressurized to a higher pressurization with a second pump P2. The two separate working streams are not recombined before being expanded. Instead, the lower-pressure working fluid 65 is admitted to a secondary turbine, or a secondary component of the same turbine, at an appropriate later stage. The illustrated configuration preserves much of the advantage of using two heat sources in parallel.

Figure 6:
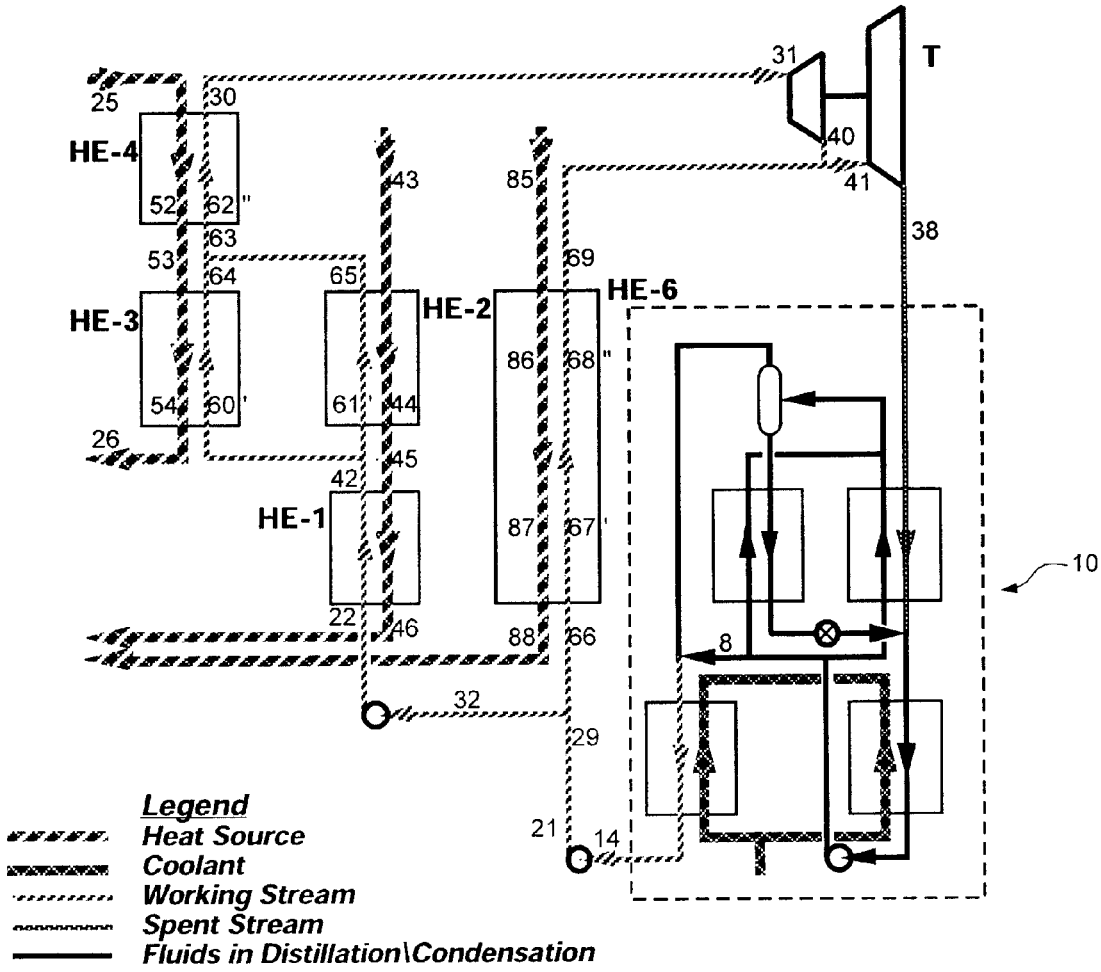
FIG. 6 illustrates a thermodynamic system for acquiring heat from more than two external heat source streams according to one embodiment of the present invention.

FIG. 6 illustrates a thermodynamic system for acquiring heat from more than two external heat source streams according to one embodiment of the present invention. In the illustrated embodiment, aspects of the systems of FIG. 1 and FIG. 5 are utilized in combination. A first heat source 25-26 and a second heat source 43-46 are utilized in a first HRVG in a system similar to that shown in FIG. 1. A third external heat source 85-88 is utilized to heat a first working stream 69-66 in path 68-67 at a heat source HE-6 in path 86-87 in a second HRVG at a lower pressurization similar to that shown in FIG. 5. As will be appreciated by those skilled in the art, aspects of different embodiments of the present invention can be combined without departing from the scope and spirit of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for implementing a thermodynamic cycle comprising:

an expander that is connected to receive a multi-component gaseous working stream and that is adapted to transform the energy of the multi-component gaseous working stream into a usable form and producing a precondensed stream;

a condenser adapted to condense the pre-condensed stream producing a liquid working stream;

a pump configured to pressurize the condensed stream to produce a working stream;

a first heat exchanger configured to boil only a first portion of the working stream outside of a distillation condensation subsystem utilizing a first source of heat external to the thermodynamic cycle; and a second heat exchanger configured to heat at least a second portion of the working stream outside of a distillation condensation subsystem utilizing a second source of heat external to the thermodynamic cycle.

2. The apparatus of claim 1, wherein the expander comprises a turbine.

3. The apparatus of claim 2, wherein the turbine includes a first component and a second component.

4. The apparatus of claim 1, wherein the expander comprises a first turbine and a second turbine.

5. The apparatus of claim 1, wherein the condenser comprises a distillation/condensation subsystem.

6. The apparatus of claim 1, further comprising one or more additional heat exchangers.

7. The apparatus of claim 1, wherein the first heat exchanger comprises an economizer preheater which heats the liquid working stream to near the bubble point.

8. The apparatus of claim 7, wherein the second heat exchanger heats the working stream in the boiling point region.

9. The apparatus of claim 8, further comprising at least a third heat exchanger that superheats the working stream to a heated gaseous working stream.

10. A method for implementing a thermodynamic cycle comprising:

condensing a multi-component spent stream producing a condensed stream;

pressurizing said condensed stream thereby producing a pressurized working stream;

splitting at least a portion of said pressurized working stream into a first substream and a second substream;

heating said first substream with heat from a first heat source external to the thermodynamic cycle such that at least a portion of said first substream boils;

heating said second substream with heat from a second heat source external to the thermodynamic cycle;

combining said heated first substream and said heated second substream producing a combined stream; and expanding said combined stream thereby producing said spent stream.

11. The method of claim 10, wherein the first and second heat sources have different temperatures.

12. The method of claim 10, wherein the first and second heat sources share a same temperature region.

13. The method of claim 10, wherein boiling a portion of said first and second substreams comprises acquiring heat from two or more heat source streams.

14. The method of claim 10, further comprising one or more additional heat sources external to the thermodynamic cycle.

15. The method of claim 10, further comprising pressurizing said second substream to a pressurization greater than a pressurization of said first substream.

16. The method of claim 10, wherein said first substream and said second substream are expanded without being recombined.

17. The method of claim 10, further comprising heating said combined working stream with heat from at least one of said first and second heat sources prior to expanding said recombined working stream.

18. The method as recited in claim 10, further comprising heating said combined stream with heat from the first heat source prior to expanding said combined stream.

19. The method as recited in claim 10, further comprising:

spitting said pressurized working stream into a first pressurized working stream and a second pressurized working stream; and heating said second pressurized working stream with heat from a third external heat source.

20. The method of claim 10, further comprising:

at least partially expanding said combined stream;

combining said at least partially expanded combined stream with said second pressurized working stream producing an at least partially expanded combined stream; and expanding said at least partially expanded combined stream to form said at least partially spent stream.

21. An apparatus for implementing a thermodynamic cycle comprising:

at least a first expander adapted to expand one or more of a first multi-component gaseous working substream and a second multi-component gaseous working substream and thereby produce a spent stream;

at least a first condenser adapted to condense said spent stream so as to thereby produce a condensed stream;

at least a first pump adapted to pressurize said condensed stream to a first pressurization so as to thereby produce a working stream;

at least a first splitter adapted to split said working stream into a first substream and a second substream;

at least a first heat exchanger adapted to heat at least a portion of said first substream utilizing at least a first heat source stream external to the thermodynamic cycle so as to thereby produce said first multi-component gaseous working substream;

at least a second pump adapted to pressurize said second substream to a second pressurization greater than said first pressurization so as to thereby produce a pressurized substream; and at least a second heat exchanger adapted to heat said pressurized substream utilizing at least a second heat source stream external to the thermodynamic cycle so as to thereby produce said second multi-component gaseous working substream.

22. A method for implementing a thermodynamic cycle comprising:

condensing a multi-component spent stream thereby producing a working stream;

splitting at least a portion of said working stream into a first substream and a second substream;

heating at least a portion of said first substream utilizing at least a first heat source stream external to the thermodynamic cycle, wherein said first substream has a first pressure;

heating at least a portion of said second substream utilizing at least a second heat source stream external to the thermodynamic cycle, wherein said second substream has a second pressure, wherein said second pressure is different than said first pressure; and expanding one or more of said first substream and said second substream thereby producing said spent stream.

* * * * *